United States Patent [19]

Zanzerl

[11] 4,257,253

[45] Mar. 24, 1981

[54] STAMPING APPARATUS WITH IMPROVED EJECTION MECHANISM

[75] Inventor: Hermann Zanzerl, Olsberg, Switzerland

[73] Assignee: Hatebur Umformmaschinen AG, Basel, Switzerland

[21] Appl. No.: 971,028

[22] Filed: Dec. 19, 1978

[30] Foreign Application Priority Data

Dec. 24, 1977 [DE] Fed. Rep. of Germany ..... 2758071

[51] Int. Cl.[3] ..... B21D 45/00

[52] U.S. Cl. ..... 72/345; 72/427; 74/568 R; 74/571 M

[58] Field of Search ..... 72/345, 344, 427; 10/11 E; 74/568 R, 571 M

[56] References Cited

U.S. PATENT DOCUMENTS

| | | | |
|---|---|---|---|
| 2,005,495 | 6/1935 | Clouse | 10/11 E |
| 2,469,570 | 5/1949 | Parish | 74/568 R X |
| 3,080,770 | 3/1963 | Frissora et al. | 74/568 R |
| 3,175,421 | 3/1965 | Watson | 74/568 |
| 3,927,549 | 12/1975 | Dycke | 72/345 |

*Primary Examiner*—Carl E. Hall

*Attorney, Agent, or Firm*—Toren, McGeady and Stanger

[57] ABSTRACT

The ejector pin for ejecting a workpiece from a die of a stamping machine is actuated by means of a cam shaft oscillated back and forth on the machine frame through less than one revolution, a radial cam mounted on the shaft, and a motion transmitting rocker carrying a cam follower. The stroke of the ejector pin can be set by angularly shifting the position of the cam on the shaft, the angular length of the cam shaft being greater than the angular spacing of the terminal shaft positions. The portion of the cam face first engaged by the cam follower during the working stroke of the ejector pin spirals uniformly outward from the cam shaft axis to an outermost position which is reached before the cam shaft movement stops.

8 Claims, 8 Drawing Figures

STAMPING APPARATUS WITH IMPROVED EJECTION MECHANISM

The invention relates to stamping mechanism in which a workpiece is shaped in a fixed die by a reciprocating punch, and particularly to an improved mechanism for ejecting the shaped workpiece from the die.

The invention will be described in its application to stamping apparatus equipped with a plurality of dies and associated punches and a transfer mechanism which receives the workpiece ejected from each die and automatically transfers it to a juxtaposed set of die and punch for further shaping, but other applications will readily suggest themselves.

It is necessary in one known ejector mechanism to hold the ejected workpiece between the ejector pin and a spring loaded retaining pin attached to the punch after the workpiece leaves the die and before it is gripped by the transfer mechanism. Differences in the lengths of workpieces processed in consecutive runs are absorbed by retaining pins movable over correspondingly long paths beyond the associated punches. The exposed, long retaining pins and their long biasing springs are vulnerable to mechanical damage and a frequent source of breakdown.

It is a common shortcoming of these and other known ejecting mechanisms that the stroke of their ejector pins cannot readily be adapted to workpieces of different lengths, nor can the ejector pin movement be stopped at the moment most beneficial for the specific operating conditions.

It is a primary object of this invention to provide an ejector mechanism which is free from the shortcomings of the known devices so that the end of the ejector stroke is reached at the earliest practical moment and the stroke of the spring loaded element associated with the punch is very short.

With this object and others in view, as will presently become apparent, the invention provides a drive mechanism for the ejector pin in which a cam shaft is moved angularly back and forth on the supporting machine frame between two terminal positions which are spaced apart less than 360°. A drive cam is mounted on the shaft for angular movement therewith and has a cam face which extends in an arc about the axis of the cam shaft. A motion transmitting train sequentially engages or scans respective portions of the cam face during the angular shaft movement and is connected to the ejector pin for moving the same in response to the varying spacing of the engaged cam face portions from the axis, as is known in itself.

According to an important feature of the invention, the angular length of the arc defined by the cam face is greater than the angular spacing of the two terminal positions of the cam shaft. The mountings for the cam permit the cam to be mounted on the shaft in each of an infinite number of angularly offset positions. The spacing of the sequentially scanned cam face portions from the cam shaft axis increases from a minimum value in one of the terminal cam shaft positions during a first portion of the angular cam shaft movement to a maximum value which is reached in an angular cam shaft position spaced intermediate the two terminal positions. The stroke of the ejector member during each oscillating angular movement of the cam shaft may thus be varied by angularly shifting the cam on the shaft.

Other features, additional objects, and many of the attendant advantages of this invention will readily be appreciated as the same becomes better understood by reference to the following detailed description of a preferred embodiment and a modification thereof when considered in combination with the appended drawing in which.

Figure 6:
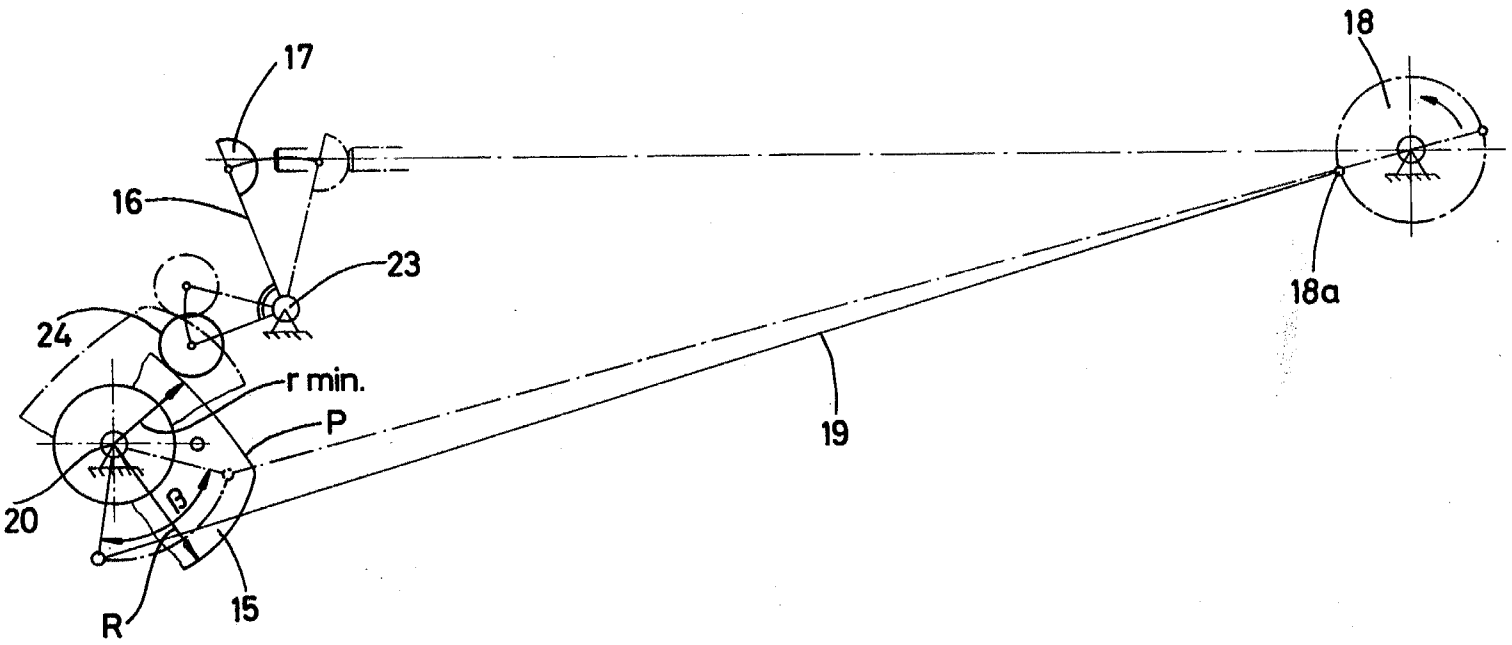
Figure 7:
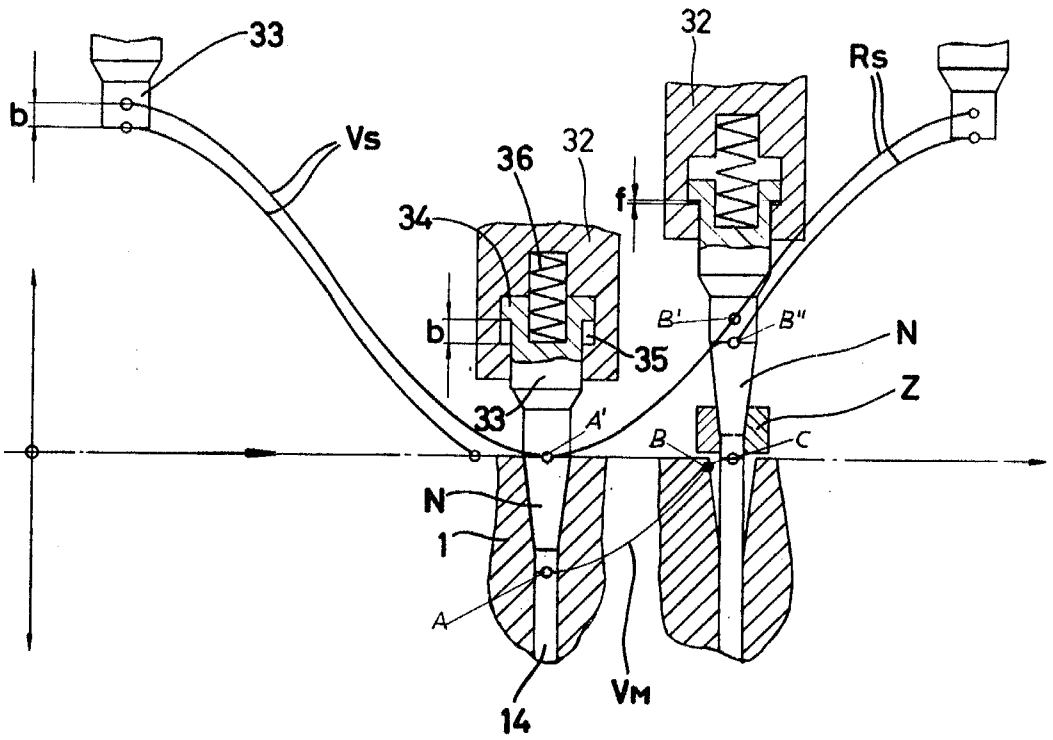
Figure 8:
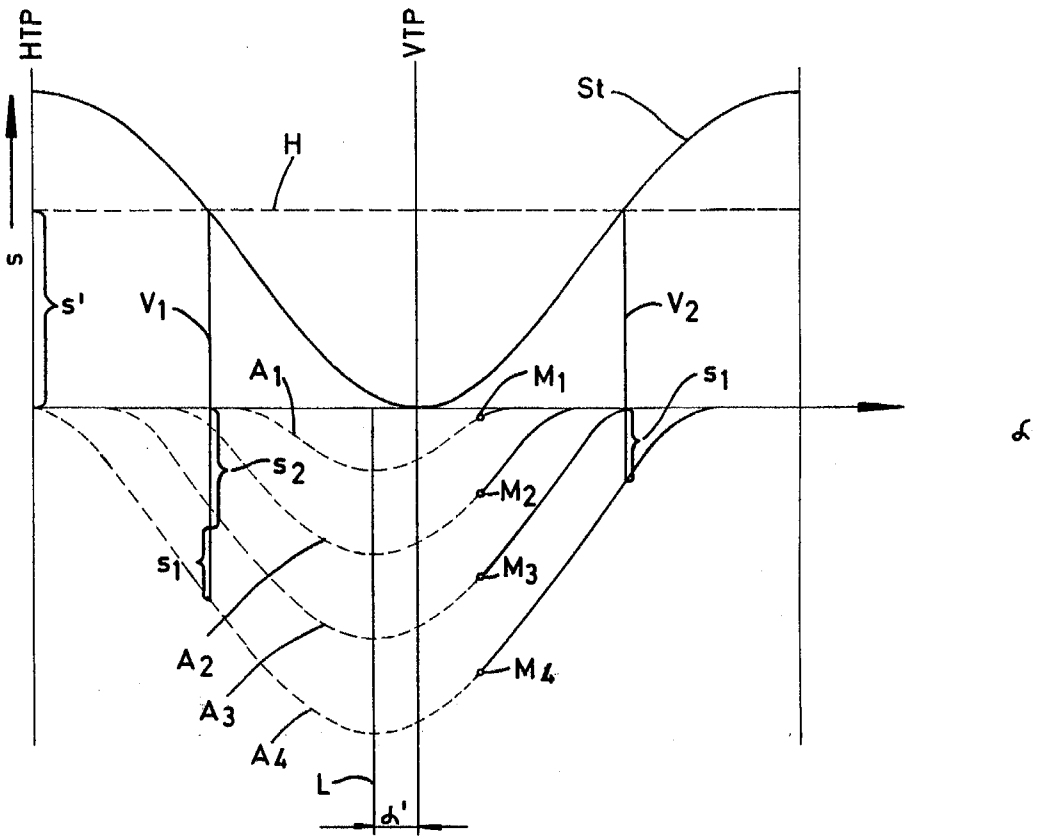

FIG. 6 diagrammatically illustrates kinematic relationships between the elements of the stamping mechanism;

FIG. 7 diagrammatically illustrates the movements of a punch and the associated ejector pin in a working cycle of the mechanism, two side elevational, sectional views of the punch and die being superimposed on the diagram for more specific illustration; and FIG. 8 diagrammatically illustrates the relationship between the movements of the punch and ejector device and the angular position of the cam shaft in the mechanism of FIGS. 1 to 5 for different settings of the drive cam on the drive shaft.

Figure 1:
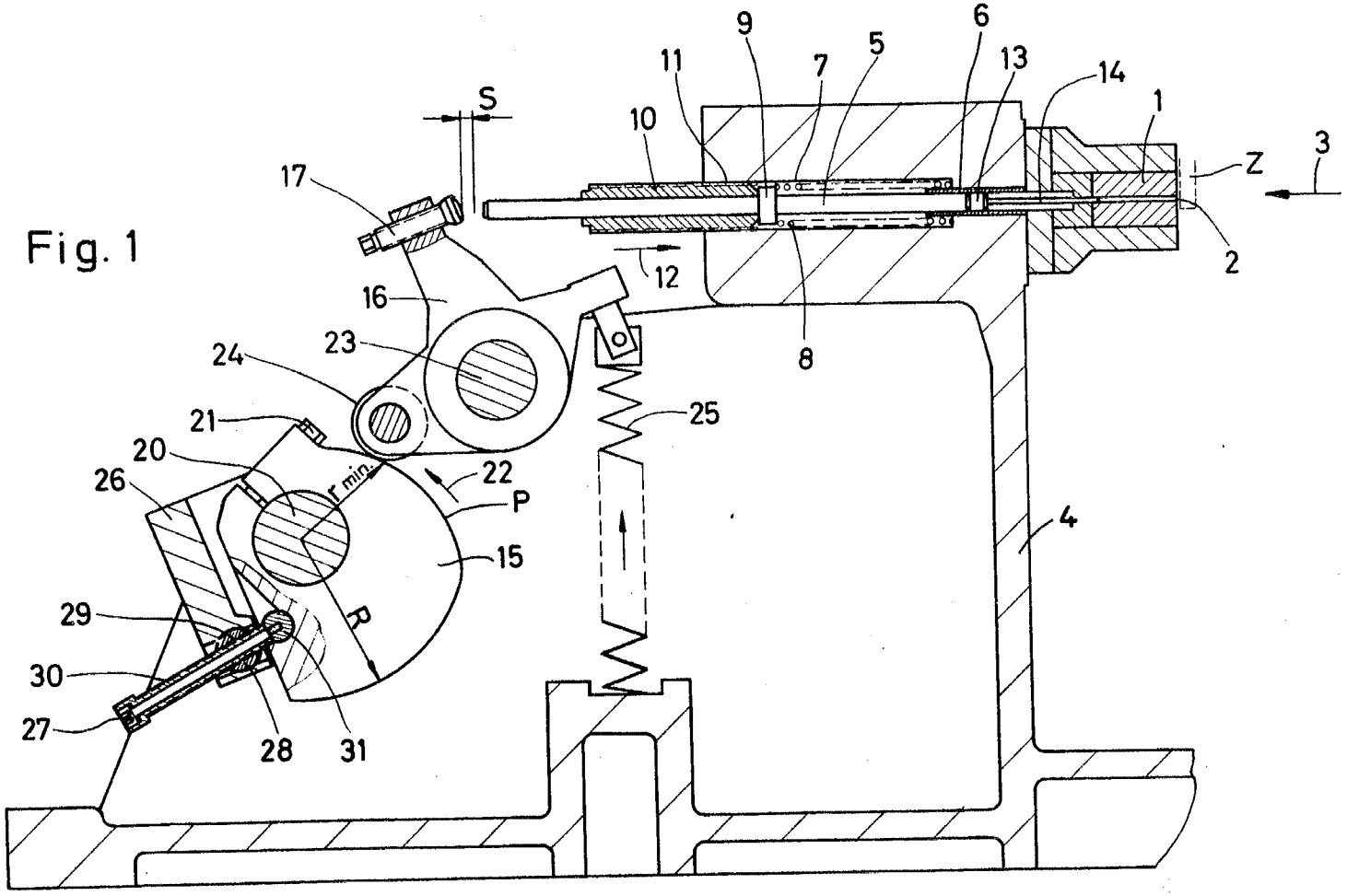
FIG. 1 shows a stamping mechanism of the invention in fragmentary side-elevational section.

Referring initially to FIG. 1, there is shown a die 1 having a cavity 2 into which a blank to be shaped is forced by a punch, not specifically illustrated, as indicated by an arrow 3. The shaped blank thereafter is to be ejected from the cavity 2 in a direction opposite to that of the arrow 3 so that it may be grasped by a transfer mechanism Z, indicated in phantom view, for sequential transfer to other dies in which it is further shaped, the several dies being juxtaposed in a common plane transverse to that of FIG. 1 on the supporting machine frame 4 as is more specifically shown in FIG. 5. Since the several dies and associated elements differ only in the shapes of the respective cavities 2, further description will be limited to the structure of FIG. 1 which will be understood to be duplicated as many times as there are juxtaposed dies with suitably modified die cavities, not themselves directly relevant to this invention.

An ejector rod 5 is coaxially guided in a bore 6 of the frame 4 which is of stepped cylindrical shape. A wider portion 7 of the bore 6 accomodates a helical compression spring 8 coiled about the rod 5 and axially confined between a shoulder in the bore 6 and a fixed collar 9 on the rod 5 so as to bias the rod rearward, that is, away from the die 1 toward the bore portion 7 until the collar 9 abuts against a transverse, annular end face of an externally threaded sleeve 10 which projects rearwardly out of the bore 6 so that it may be adjusted manually by turning it on threads 11 in the bore 6. More specifically, the rearmost position of the rod 5 may be shifted toward the die 1 by threadedly moving the sleeve 10 in the direction of an arrow 12.

A guide ring 13 is slidably received in the narrow end portion of the bore 6 for coaxially guiding an ejector pin 14 fixedly attached to the ring and dimensioned for movement with minimal clearance through the ejector port of the die 1 into and out of the cavity 2.

The ejection movement of the pin 14 is derived from a radial cam 15 by way of a motion transmitting train including a rocker 16 and a striker pin 17 threadedly adjustable on the rocker 16 for engagement with the end portion of the rod 5 which projects rearwardly from the sleeve 10. As is shown in FIG. 6 in a diagrammatic manner and not in itself novel, a crankshaft 18 is rotated continuously on the machine frame 4 by a non-illustrated prime mover and carries an eccentric crank pin 18*a* which may be adjusted along a circle about the axis of crankshaft rotation in a conventional manner. A connecting rod 19 links the crank pin 18*a* with a radial arm on a cam shaft 20 so that the shaft 20 moves angularly back and forth through an angle $\beta$ during each revolution of the crank shaft 18. When the crank pin 18*a* is shifted on the crank shaft 18, the angular stroke of the cam shaft 20 is not changed, but the crank shaft 18 also drives the reciprocating slide on which the several punches associated with the dies 1 are mounted in a conventional, non-illustrated manner, and shifting of the pin 18*a* thus affects the synchronization of the punch movement with the movements of the associated ejector pins 14 as will presently become apparent.

Reverting to FIG. 1, it is seen that the cam 15 is split and releasably fixed to the cam shaft 20 by a clamping screw 21 which bridges the split in the cam 15. When the screw 21 is relaxed, the cam 15 may be turned on the shaft 20. The rocker 16 is pivotally mounted on a stub shaft 23 fixed on the frame 4 and carries a cam follower roller 24 held in rolling engagement with the cam face P of the cam 15 during the oscillating movement of the shaft 20 by a helical compression spring 25 interposed between the rocker 16 and the stationary machine frame 4.

When the screw 21 is loosened, the cam 15 may be shifted continuously and precisely between respective angular positions on the shaft 20 by an adjustment mechanism mounted on a carrier frame 26 which is fixedly attached on the shaft 20. A passage in the frame 26 contains a heavy pin 28 freely rotatable in the recess about its axis which is parallel to that of the shaft 20. A threaded transverse bore 29 in the pin 28 receives an externally threaded abutment sleeve 30. A screw 27 is received in the sleeve 30 and extends into a recess of the cam 15 for threaded engagement with a pivot pin 31 whose ends are journaled in the side walls of the recess. When tightened, the screw 27 holds an annular end face of the sleeve 30 in abutting engagement with the pivot pin 31 so that the angular position of the cam 15 may be varied in a precise, stepless manner by turning the freely accessible sleeve 30, while released by the screw 27, so that the sleeve applies a force to the cam 15 tangentially relative to a circle about the axis of the cam shaft 20, and by thereafter tightening the screw 27.

While the cam 15 is turned by the connecting rod 19 in the direction of the arrow 22 in FIG. 1, the cam follower roller 24 travels along sequential portions of the cam face P of the cam 15 whose radius of curvature increases initially from a minimum value of $r_{min}$ in one angularly terminal position of the shaft 20 along an Archimedes spiral and ultimately to a constant maximum value R. As is inherent in the described structure, the abutment face of the striker pin 17 moves from the initial position shown in FIG. 1 toward the ejector rod 5 by a distance S practically identical for each identical unit of angular movement of the cam 15 with the shaft 20 until it engages the end face of the rod 5 in the position of FIG. 2, and thereafter shifts the rod 5 and thereby the ejector pin 14 into the position of FIG. 3 in which the free end of the pin 14 is flush with the end face of the die 1, and the non-illustrated, shaped workpiece clears the die 1 for transverse movement to the next die.

Figure 2:
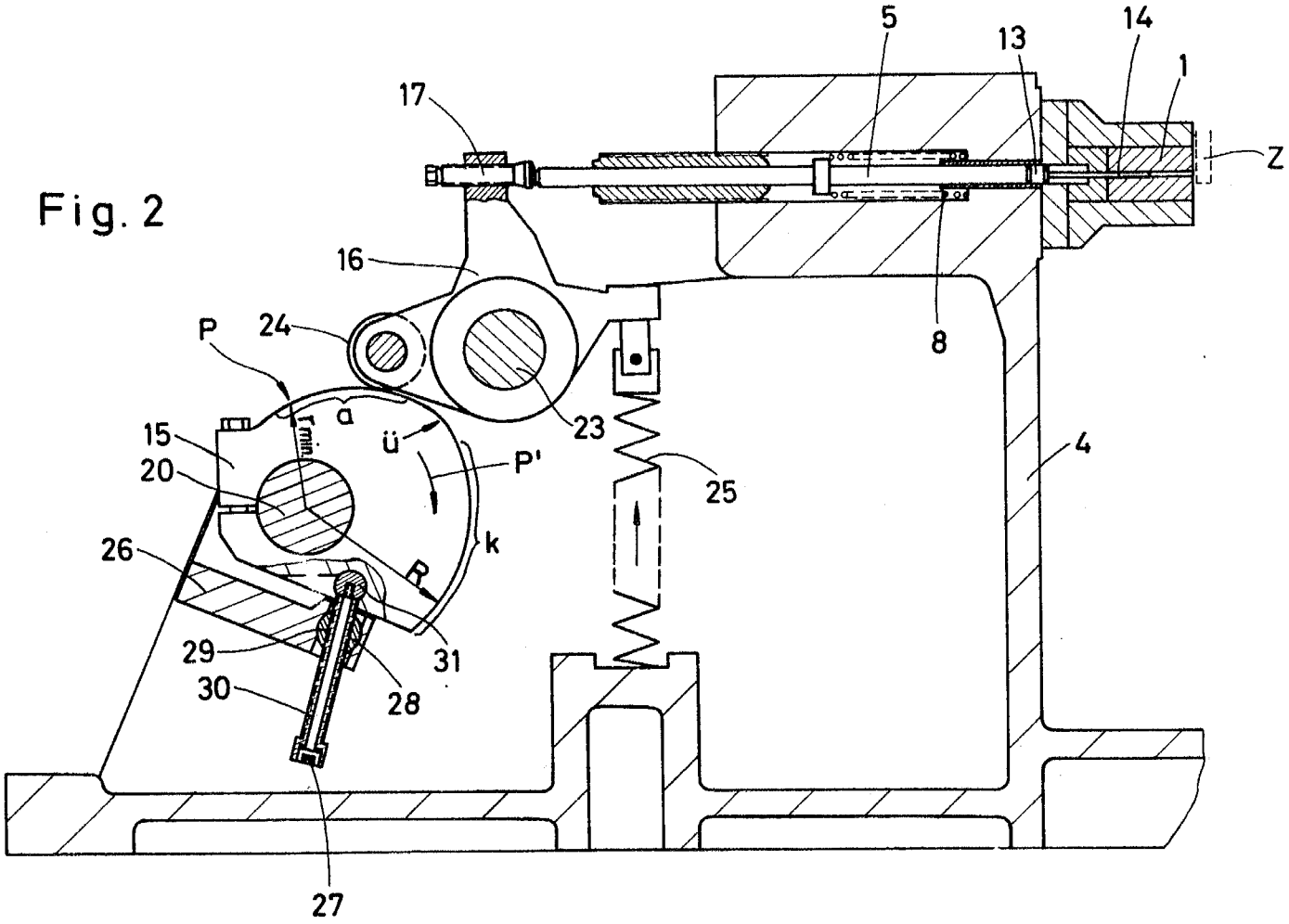
FIGS. 2 and 3 illustrate the mechanism of FIG. 1 in analogous views, but in different operating positions.
Figure 3:
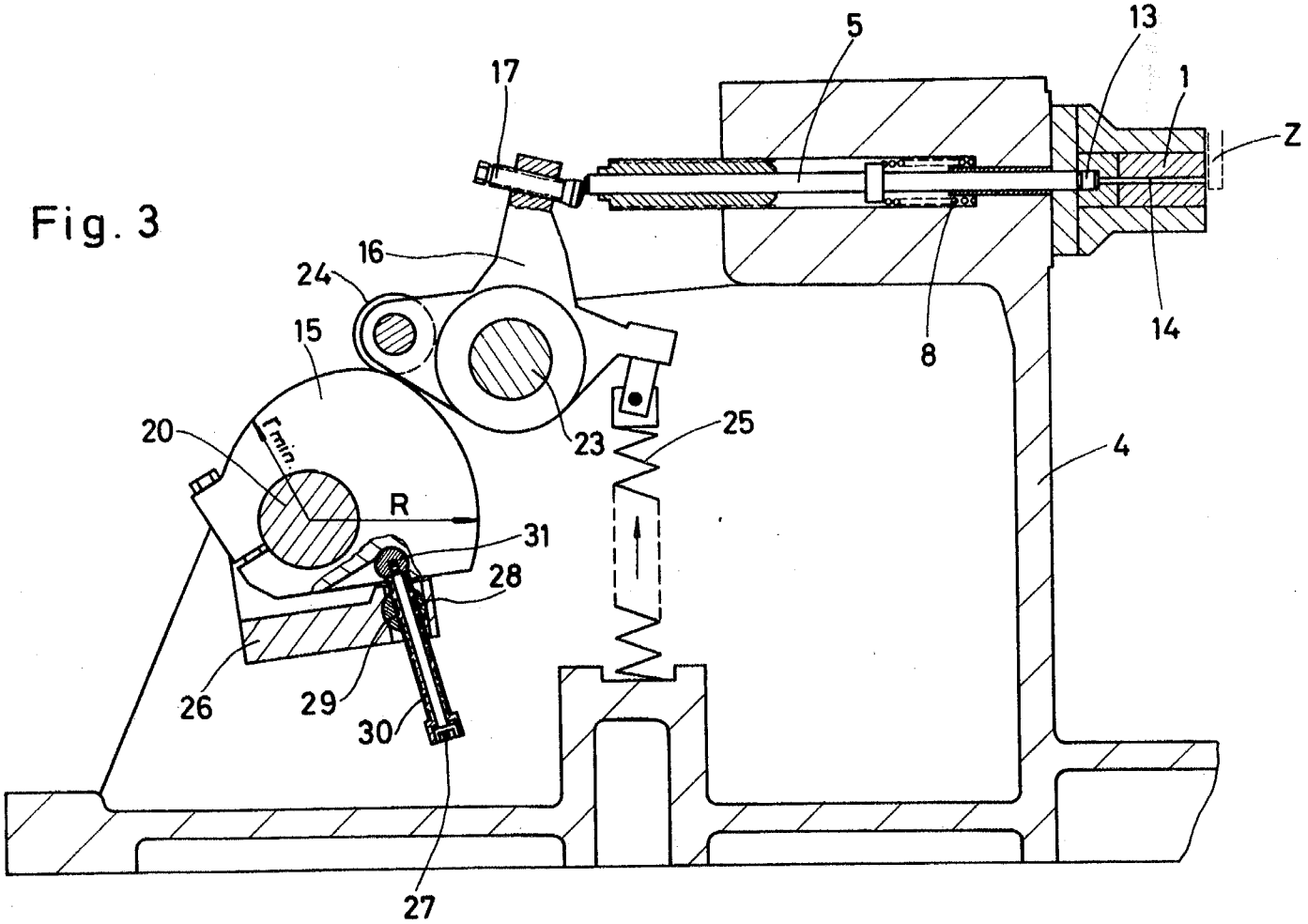

As is specifically indicated in FIG. 2, the end portion a of the cam face P engaged by the cam follower roller 24 moving away from the cam face portion of minimum radius of curvature $r_{min}$ is curved along an Archimedes spiral. The other end portion k of the cam face P is cylindrically arcuate with a radius R greater than any radius of curvature of the spiral portion a or of the transitional cam face portion ü which circumferentially connects the portions a and k. Actually, the ejector pin 14 is moved inward of the die cavity 2 and the bore 6 by a blank pushed into the die 1 by the punch, not itself seen in FIGS. 1 to 3, and the mode of operation may not be affected if the radius of curvature of the cam face portion k decreases again after having reached its maximum R spacedly intermediate the two ends of the face P.

Figure 4:
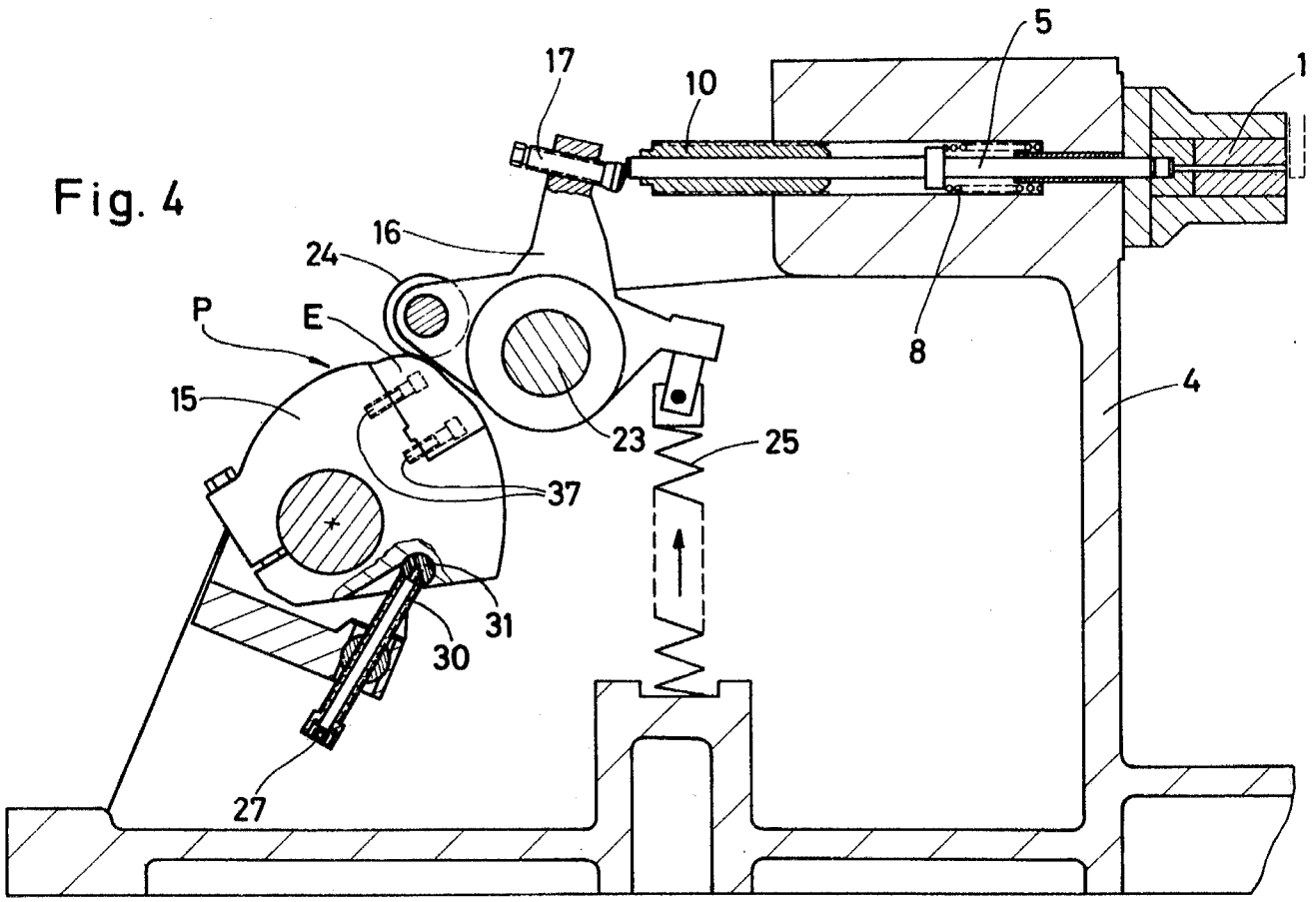
FIG. 4 shows a partial modification of the same mechanism in a view approximately corresponding to that of FIG. 2.
Figure 5:
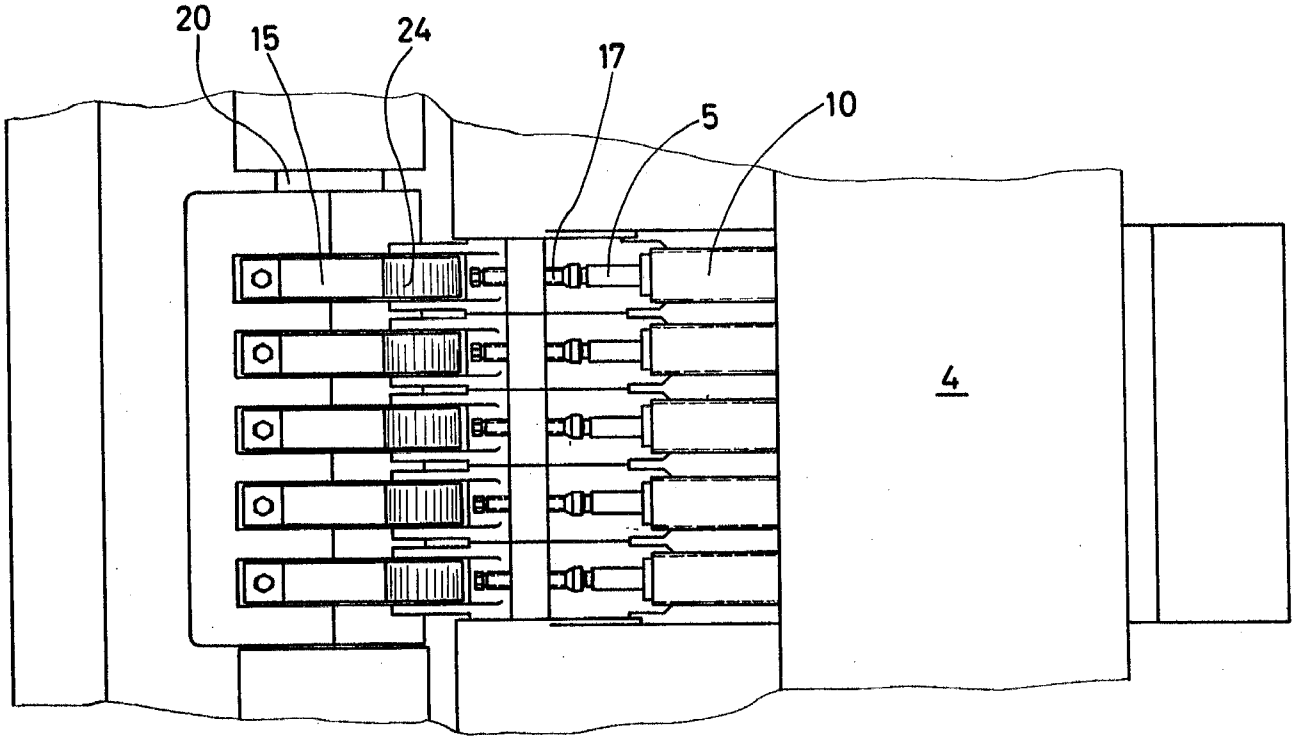
FIG. 5 is a fragmentary top plan view of the apparatus of FIGS. 1 to 3, also representative of the apparatus of FIG. 4.

If the shaped workpiece is tubular or otherwise formed with a recess engageable by the free end of the ejector pin 14, the workpiece cannot laterally clear the die cavity 2 when the front end of the ejector pin 14 is flush with the end face of the die 1, and the drive cam 15' illustrated in FIG. 4 is modified for this purpose by an interchangeable insert E releasably attached to the body of the cam by countersunk screws 37 and imparting to a portion of the cam face P contiguously consecutive to the spiral portion a maximum radius greater than corresponds to the afore-mentioned radius R. The ejection stroke of the pin 14 thus terminates in a position in which the free end of the pin projects beyond the front face of the die 1 sufficiently to permit unimpeded lateral displacement of a recessed workpiece. The apparatus of FIG. 4 is not otherwise different from that described with reference to FIGS. 1–3, and may be converted to the exact structural and functional equivalent of the first-described embodiment by replacing the insert E by another insert restoring the configuration of the cam face P to that described in the earlier Figures.

The angle $\beta$ which separates the two terminal positions of the cam shaft 20 is constant under all operating conditions of the stamping mechanism, but the angular length of the cam face P is much greater as is best seen in FIG. 6, and the angular position of the cam 15 on the shaft 20 determines which portion of the cam face P is scanned or travelled over by the cam follower 24 while the cam 15 moves through the angle $\beta$. The path of the cam follower 24 may thus include a larger or smaller part of the spiraling path portion P and the ejection stroke of the pin 14 varied accordingly. Unless the contour of the cam face P is modified in the manner illustrated in FIG. 4, the ejection stroke terminates when the pin 14 is flush with the front face of the die 1 regardless of the actual length of the stroke as set by turning the cam 15 on the shaft 20. For a given insert E, the end of the outward pin stroke is equally uniquely determined regardless of the length of the stroke which may be varied by modifying the angular position of the cam 15 on the shaft 20.

The effect of this precise definition of the ejector pin movement regardless of the actual length of the ejection stroke on the cooperation between the pin 14 and the punch 33 is evident from the partly diagrammatical representation of FIG. 7 in which the ordinate indicates displacement, the abscissa time or the equivalent angular displacement of the cam shaft 20.

As the punch 33 descends toward the die 1, it shapes in the die cavity a workpiece N which flares conically outward of the die, and thus is not held in a defined position by the die walls while being ejected by the pin 14 and requires backing by the retreating punch 33 during ejection.

The punch 33 is longitudinally movable in a bore of the afore-mentioned slide 32 common to the several punches. A collar 34 on the punch 33 is confined in an enlarged portion 35 of the slide bore so as to limit displacement of the punch 33 to a distance b. A weak, helical compression spring 36 in the bore biases the punch outward of the slide, but cannot resist the shaping stresses.

As the punch 33 is moved from its retracted position indicated at the left of FIG. 7 toward the die 1 by the crank shaft 18, its front face follows a path limited by two curves Vs separated by the distance b and depending on the ability of the spring 36 to expel the punch from the slide 32 against external forces not directly relevant to this discussion. After the punch face engages the workpiece N, the point A′ on the front face of the punch 33 shifts toward the upper curve Vs and is located on that curve when full shaping force is transmitted from the slide 32 to the workpiece N by the punch 33.

During the subsequent retraction of the punch along a line Rs from A′ to B′ or B″ and the simultaneous ejection stroke of the pin 14 from A to B and further to C along the curve $V_M$, any deviation from parallel orientation of the two curves is absorbed by the spring 36 which still exerts a retaining force indicated by an available path f of the collar 34 in the slide 32 in the fully ejected position of the workpiece N shown at the right of FIG. 7. Further retracting movement of the punch follows a path between two curves Rs separated by the distance b, as explained with reference to Vs, while the shaped workpiece N is removed by the transfer mechanism Z.

The effect of an angular shift of the cam 15 on the cam shaft 20 is diagrammatically illustrated in FIG. 8 in which the ordinate indicates displacement s in the direction of movement of the punch 33 and of the ejector pin 14 while the abscissa indicates time in terms of angular displacement $\alpha$ of the crank shaft 18 during one full revolution of the crankshaft from one fully retracted position HTP of the punch to its fully advanced position VTP and back to the next fully retracted position, as represented by the fully drawn line St.

The crank pin 18*a* is offset from its position of full synchronization between the punch 33 and the rocker 16 by an angle $\alpha'$ so that the rocker reaches the fully retracted position exemplified in FIG. 1 at a time L which slightly precedes termination of the workpiece-shaping stroke by the punch 33. Broken lines $A_1$ to $A_4$ illustrate the movements of the rocker 16, and more specifically of the striker pin 17 in respective angular positions of the cam 15 on the shaft 20, the striker pin engaging the ejector rod 5 at respective points $M_1$ to $M_5$ so that the ejector pin 14 thereafter participates in the movement as indicated by a fully drawn portion of each of the curves $A_1$ to $A_4$.

A reference line H is drawn parallel to the abscissa at an arbitrarily selected distance s′ so as to intersect the curve St in two points from which lines $V_1$, $V_2$ are drawn to intersect the abscissa $\alpha$ at right angles.

As is evident from inspection of FIG. 8, the line $V_1$ intersects the broken line $A_4$ much below its point of intersection with the line $V_2$. As translated into operating characteristics of the stamping arrangement, this indicates that an excess path $s_2$ of the punch 33 is available for shaping the workpiece, the distance $s_1$ of the line $A_4$ from the abscissa along the line $V_2$ being equal to the spacing of the lines $A_4$, $A_3$ along the line $V_1$. It is further evident from inspection of FIG. 8 that the path of the punch available for shaping the workpiece may be changed steplessly by shifting the cam 15 on the shaft 20, so as to modify the apparatus for workpieces of different lengths.

The angle value $\alpha'$ may be similarly varied by shifting the crank pin 18*a* on the crank shaft 18, but this is not necessary under many practical conditions, and the value of $\alpha'$ may be set during assembly of the stamping mechanism. If greater flexibility is required at the stamping plant, however, a disc coaxially fixed on the shaft 18 may be provided with a circular row of openings for receiving the crank pin 18*a* in suitable alternative positions.

The apparatus of the invention may be employed to advantage for deburring workpieces without structural modification. Because of the interval between the reversals of rocker and punch movements at L and VTP respectively, the striker pin 17 already travels at an adequate velocity when the punch starts retracting so that the energy transmitted by the striker pin to the workpiece may be employed for removing burrs from the workpiece in a conventional manner, not shown.

It should be understood, of course, that the foregoing disclosure relates only to a preferred embodiment and that it is intended to cover all changes and modifications of the example of the invention herein chosen for the purpose of the disclosure which do not constitute departures from the spirit and scope of the invention set forth in the appended claims.

What is claimed is:

1. In a stamping mechanism including a support, a die defining a cavity therein and fixedly mounted on said support, a punch reciprocable on said support in a direction inward and outward of said cavity for shaping a workpiece in said cavity, an ejector member movably mounted on said die for ejecting the shaped workpiece from said cavity, and drive means for actuating said ejector member, said drive means including a cam shaft having an axis and said cam shaft mounted on said support for angular movement back and forth about said axis between two terminal positions spaced apart by less than 360°, a cam member, mounting means mounting said cam member on said shaft for angular movement therewith, said cam member having a cam face extending in an arc about said axis, and motion transmitting means mounted on said support and sequentially engaging respective portions of said cam face during said angular movement of said shaft, said motion transmitting means engageable with said ejector member for moving the ejector member in response to varying spacing of the engaged portions of said cam face from said axis, the improvement which comprises:

(a) the angular length of said arc relative to said axis being greater than the angular spacing of said two terminal positions and being less than 360° and including said two terminal positions, (b) said mounting means including means for mounting said cam member on said shaft in each of a plurality of positions angularly offset about said axis, (c) the spacing of said sequentially engaged portions on said cam face from said axis increasing from a minimum value in one of said terminal positions during a first portion of said angular movement to a maximum value in an angular position of said shaft spaced between said terminal positions, (1) whereby the stroke of said ejector member during said angular movement of said shaft may be varied by angularly shifting said cam member on said shaft.

2. In a mechanism as set forth in claim 1, said motion transmitting means including means for linearly moving said ejector member by a constant distance in response to each movement of said shaft through a constant angle during said first portion of said angular movement.

3. In a mechanism as set forth in claim 1, said portions engaged during said first portion of said angular movement extending about said axis substantially along a spiral.

4. In a mechanism as set forth in claim 1, said mounting means including a carrier secured against angular displacement relative to said shaft, and an abutment threadedly mounted on said carrier for engaging said cam member tangentially relative to a circle about said axis.

5. In a mechanism as set forth in claim 1, said spacing of said portions decreasing from said maximum value during movement of said shaft from said intermediate position to the other one of said terminal positions thereof.

6. In a mechanism as set forth in claim 5, said cam member including a body portion, an insert, and fastening means for fastening said insert to said body portion in a position in which said insert constitutes the portions of said cam face spaced from said axis by said maximum value and contiguously adjacent portions of said cam face decreasing in said spacing toward each of said terminal positions.

7. In a mechanism as set forth in claim 6, said insert being spaced from the portions of said cam face engaged by said motion transmitting means in said terminal positions of said shaft.

8. In a mechanism as set forth in claim 1, said drive means including a crank shaft continuously rotatable about an axis on said support and connected to said punch for reciprocating the punch inward and outward of said cavity, a crank pin eccentrically mounted on said crank shaft, a connecting rod connecting said crank pin to said cam shaft for moving the cam shaft back and forth between said terminal positions in response to continuous rotation of said crank shaft, the position of said crank pin on said crank shaft being adjustable along a circular arc about the axis of said crank shaft.

* * * * *